US005346072A

United States Patent [19]

Dian et al.

[11] Patent Number: 5,346,072

[45] Date of Patent: Sep. 13, 1994

[54] SORTING INSTALLATION FOR ARTICLES HAVING DIFFERENT DESTINATIONS

[75] Inventors: Jean-Raoul Dian, Paris; Michel Gand, Champlan, both of France

[73] Assignee: Compagnie Generale D'Automatisme CGA-HBS, Bretigny sur Orge, France

[21] Appl. No.: 44,057

[22] Filed: Apr. 8, 1993

[30] Foreign Application Priority Data

Apr. 13, 1992 [FR] France ..... 92 04504

[51] Int. Cl.[5] ..... B07C 5/00

[52] U.S. Cl. ..... 209/584; 209/900; 198/366; 271/3.1

[58] Field of Search ..... 209/546, 564, 583, 584, 209/900; 271/3.1, 298; 198/365, 366, 367

[56] References Cited

U.S. PATENT DOCUMENTS

| | | | |
|---|---|---|---|
| 3,977,513 | 8/1976 | Rushforth | 198/365 |
| 4,388,994 | 6/1983 | Suda et al. | 209/900 X |
| 4,601,396 | 7/1986 | Pavie | 209/900 X |
| 4,615,446 | 10/1986 | Pavie | 209/583 |
| 5,042,667 | 8/1991 | Keough | 209/584 X |

FOREIGN PATENT DOCUMENTS

| | | |
|---|---|---|
| 0144908 | 6/1985 | European Pat. Off. . |
| 0429118 | 5/1991 | European Pat. Off. . |
| 1329251 | 4/1963 | France . |
| 2387697 | 11/1978 | France . |

*Primary Examiner*—D. Glenn Dayoan
*Assistant Examiner*—Tuan N. Nguyen
*Attorney, Agent, or Firm*—Sughrue, Mion, Zinn, Macpeak & Seas

[57] ABSTRACT

The present invents relates to a sorting installation for articles having different destinations, especially letters. The installation comprises n sorting machines connected to a common conveyor. Each machine comprises pigeonholes associated with $p_i$ of the N possible destinations. The articles introduced at the input of the machine and not corresponding to one of the $p_i$ destinations are directed towards the storage regions, each region corresponding to the destinations associated with the other n−1 sorting machines to which the articles are periodically transferred.

3 Claims, 2 Drawing Sheets

SORTING INSTALLATION FOR ARTICLES HAVING DIFFERENT DESTINATIONS

FIELD OF THE INVENTION

The present invention relates to a sorting installation for articles having different destinations.

More particularly, the invention concerns an installation which allows articles such as letters or packets forwarded by the postal services for example to be sorted, in order to distribute these articles into different storage regions, each corresponding to a destination or a group of destinations.

BACKGROUND OF THE INVENTION

In postal sorting centers sorting machines are used comprising in general both a restricted number of stackers of large capacity assigned to the major destinations of the articles to be sorted and a greater number of receptacles, called pigeonholes, of smaller size, for the routes or destinations which are little-used.

It will be understood that the conveyors of sorting machines allocated to feeding articles to the pigeonholes corresponding to little-used destinations carry a flow of articles to be sorted much less than their capacity, at least in statistical terms. There is thus under-usage of these conveyors, which tends to increase the overall cost of operation of the sorting installation.

OBJECTS AND SUMMARY OF THE INVENTION

One object of the present invention is to provide a sorting installation for articles having different destinations which makes it possible to ensure that the level of use of conveyors associated with the pigeonholes for the less used destinations will be substantially increased.

Another object of the invention is to provide a sorting installation in which all the articles corresponding to the same little-used destination are all located in the same, unique pigeonhole at the end of the sorting operation.

In order to achieve this aim, the installation for sorting articles having different destinations, said destinations being divided into N groups of little-used destinations, comprises n sorting machines, each machine $M_i$ comprising $p_i$ storage regions corresponding to $p_i$ of the N groups of little-used destinations, in such a manner that:

$$\sum_{i=1}^{i=n} p_i = N,$$

common article transfer means connecting the n machines $M_i$ in a closed circuit, each sorting machine comprising conveyor means for transferring the articles placed on its input having such destinations as pertain to the $p_i$ groups associated with the machine to the $p_i$ storage regions of the machine, n−1 intermediate storage regions, each intermediate storage region being associated with the group of destinations associated with a respective one of the n−1 other machines, conveyor means for transferring the articles of the destination not pertaining to the $p_i$ groups of destinations corresponding to the machine to the appropriate intermediate storage region, means for transferring the articles stored in each intermediate storage region to said common transfer means, temporary storage means for storing the articles places in said common transfer means whose destination pertains to one of the $p_i$ groups associated with said machine, and means for conveying the articles stored in the temporary storage means to said conveyor means corresponding to said $p_i$ storage regions of the machine in accordance with their destination.

In other words, the sorting installation according to the invention comprises n sorting machines which are interconnected by common conveyor means. The handling of the articles corresponding to little-used destinations is effected in the following manner. These destinations are distributed in groups, each machine being assigned to a certain number of these groups. When an article pertaining to a little-used destination is introduced to a sorting machine, either the article corresponds to a group of destinations associated with that machine to which the article is presented and it is sent directly to the corresponding storage region of this machine, or it pertains to a group of destinations assigned to another machine.

In the latter case, the article is passed to the machine associated with the group of destinations to which this article pertains, via the common conveyor means which interconnect all the sorting machines.

It will thus be understood that, for the overall installation, i.e. the set of n sorting machines, there is overall a single pigeonhole or storage region corresponding to each group of little-used destinations. Thus the conveyor associated with this pigeonhole is used to its maximum level, taking into account the articles to be sorted by the installation, since all the articles having this group of destinations will follow this conveyor. Furthermore all the articles corresponding to the same little-used destination end up in the same pigeonhole and there is no question of proceeding to a re-grouping operation, as in the known installations.

According to a preferred embodiment, each of the n sorting machines further comprises main storage regions corresponding to major destinations and each machine comprises means for conveying articles corresponding to these main destinations to the associated main storage regions.

BRIEF DESCRIPTION OF THE DRAWINGS

Other features and advantages of the present invention will appear more clearly from a reading of the description which follows of a preferred embodiment of the invention, given by way of non-limiting example. The description refers to the accompanying drawings, in which.

MORE DETAILED DESCRIPTION

In the present text, "article" means any article capable of being routed, in particular by the postal services. It can thus apply to letters, postcards, packets, etc. Likewise, in the following description, the term "destination" is used for simplicity to mean either a single destination or a group of destinations associated with the same pigeonhole. Accordingly it must be taken that there is one-to-one correspondence between pigeonholes and destinations.

Figure 1:
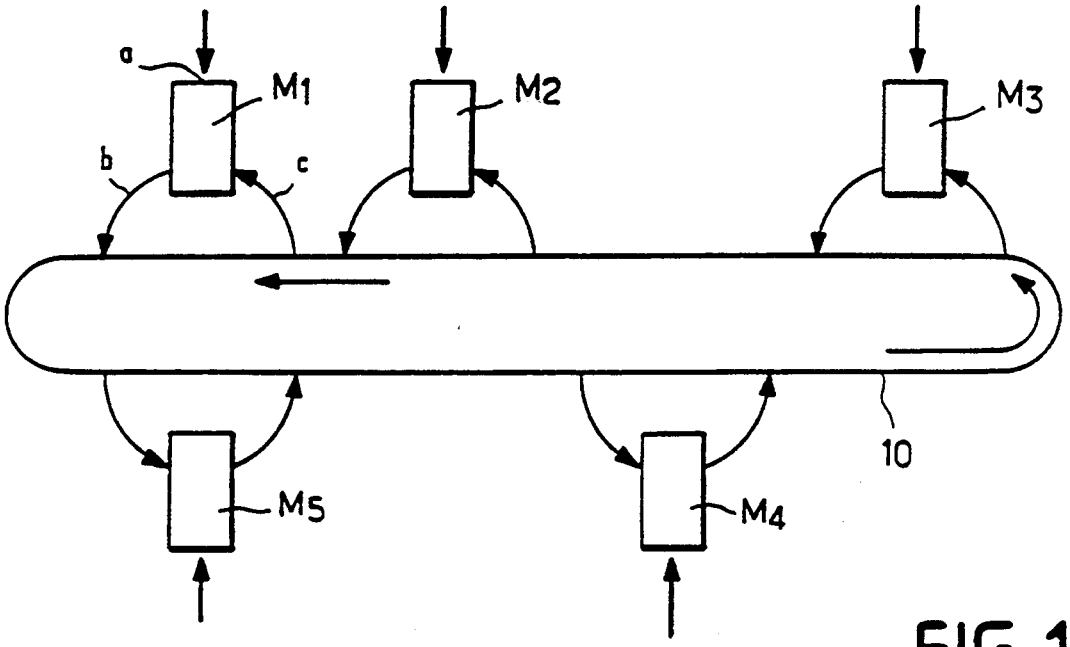
FIG. 1 is a simplified view of the overall sorting installation.

Referring firstly to FIG. 1, the sorting installation will now be described. In the particular example considered, this comprises five identical sorting machines M1, M2, M3, M4 and M5. These sorting machines are interconnected in a closed loop by a common conveyor 10. Each sorting machine M1 to M5 receives the articles to be sorted at its input a. As will be explained later, a proportion of these articles will be stored after sorting in the machine M1, a proportion is reintroduced to the common conveyor 10 by the output b of the machine, and a proportion of the articles coming from other machines is reintroduced into each sorting machine via its input c.

Figure 3:
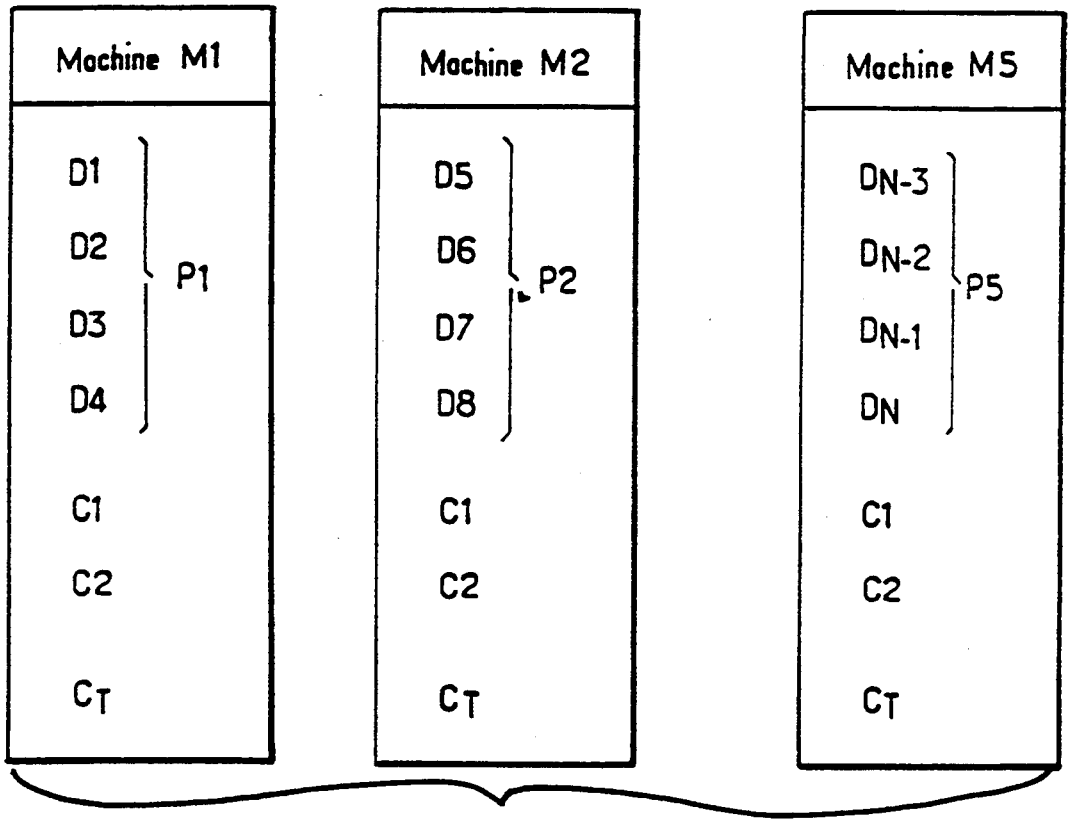
FIG. 3 is a table showing the distribution of various destinations in relation to different sorting machines.

As already indicated above and as shown best in FIG. 3, the articles have to be distributed to N+T destinations. Among these destinations, some correspond to major usage of articles (T in the case of the present description). These destinations are referenced C1 to CT in the table of FIG. 3. However there are N destinations corresponding to much reduce usage. According to one feature of the present invention, these N destinations with reduced usage, referenced D1 to DN, are distributed among the sorting machines, M1 to M5 in the particular example. The articles for the destinations D1 to D4 will be stored in the machine M1, the destinations D5 to D8 in the machine M2, etc. and the destinations DN-3 to DN in the machine M5. Thus the storage regions or pigeonholes corresponding to each of the N groups of little-used destinations are located in a single machine.

More generally, $p_i$ destination of low usage are associated with each machine Mi. Preferably the values of $p_i$ are the same for all the machines but this is by no means obligatory. In the example described all the $p_i$ are equal to 4.

Figure 2:
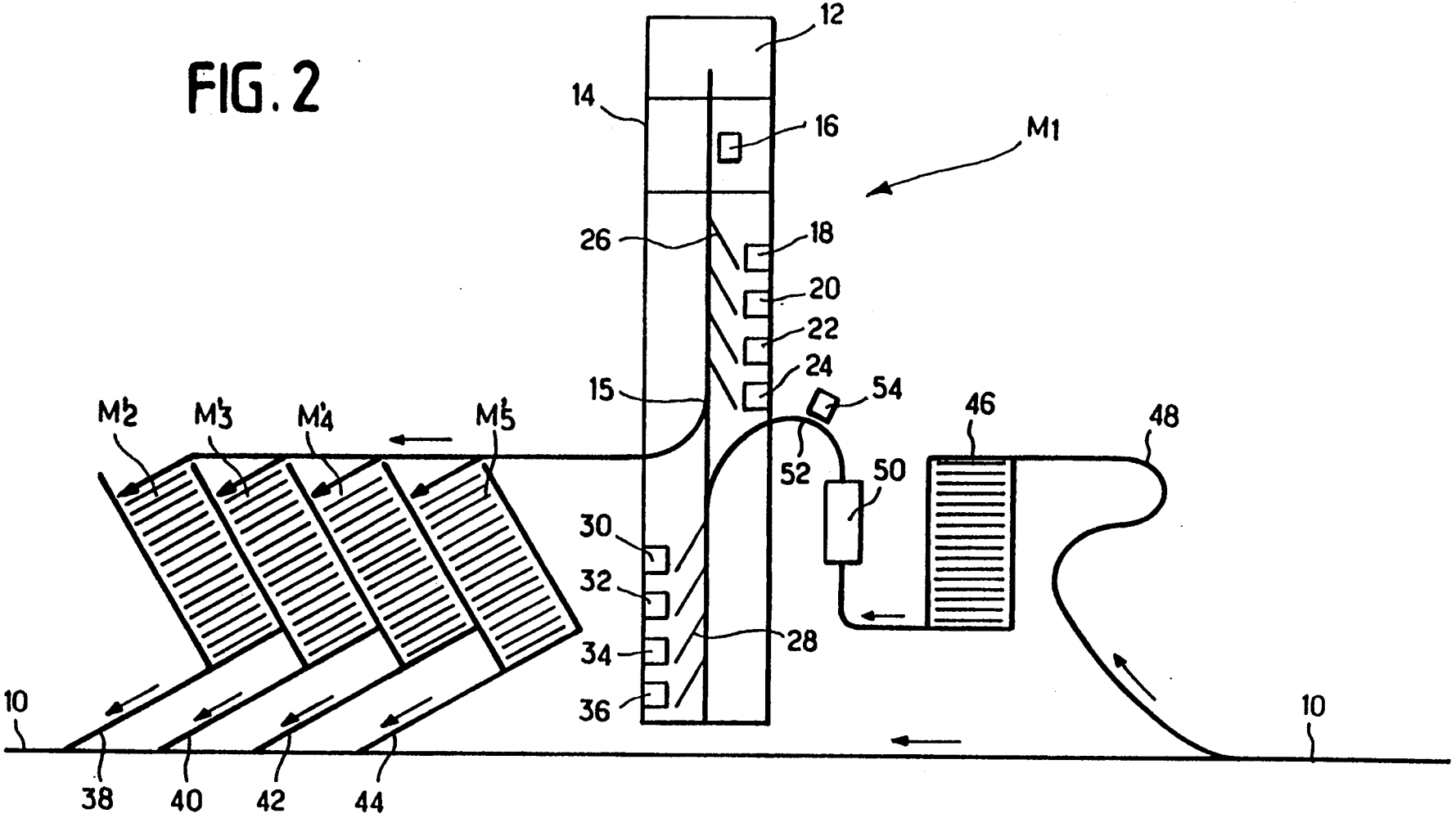
FIG. 2 shows the organization of one sorting machine and its connection to the common conveyor means for the articles.

Referring now more particularly to FIG. 2, an embodiment of the sorting machine M1 will be described, and its interconnections with the common conveyor 10.

In known manner, the sorting machine M1 comprises an input module 12, formed by a magazine/de-stacker assembly for example, an address recognition module 14 such that the destination of each article to be sorted shall be taken into account at the output of this module by a read head 16. There is also a parallel output module in the machine, comprising the stackers 18 to 24 or main storage regions, corresponding to the major destinations reference C1 to CT in the table of FIG. 3. The conveyors associated with these various stackers have the general reference numeral 26. They are fed by a main conveyor 15 which serves the assembly of the sorting machine. In this region of the machine, the level of usage of the conveyor is satisfactory, since the probability of having an article corresponding to one of the destinations associated with the stackers 20 to 24 is high. For the articles corresponding to a destination of reduced usage, that is to say the destinations D1 to DN, two cases arise: in one case the destination pertains to one of the destinations D1 to D4 associated with the machine M1; in this case the articles are transferred by the parallel conveyors 28 to one of the pigeonholes 30 to 36 of the sorting machine M1, each of these pigeonholes being associated with one of the destinations D1 to D4. On the contrary, if the article being sorted belongs to one of the groups of the destinations D5 to DN, the article is directed by the common conveyor to one of four intermediate storage regions M'2 to M'5, each of these intermediate storage regions being associated with the destination groups pertaining to the sorting machines M2 to M5.

Each intermediate storage region M'2 to M'5 is connected by one of the conveyors 38 to 44 to the common conveyor 10. This thus allows the transfer via the common conveyor 10 of articles located in the intermediate storage regions M'2 to M'5 to the sorting machines M2 to M5. The sorting machine also comprises an input storage region 46 or temporary storage region connected to the common conveyor device 10 by the conveyor 48. As will be explained later, this temporary storage region 46 serves to collect the set of articles which have been initially introduced into the sorting machine M2 to M5 and whose destinations are associated with the machine M1, i.e. whose destinations pertain to the groups D1 to D4. The output of the temporary storage region 46 is connected to a stabilizing table 50 for the articles to be sorted and via a conveyor 52 to the main conveyor 15 of the sorting machine M1. The conveyor 52 is connected to the main conveyor 15 downstream of the conveyor leading to the intermediate storage regions M'2 to M'5 and upstream of the conveyors 28 associated with each of the stackers 30 to 36 of the sorting machine M1. As has already been explained, the set of articles placed successively in the intermediate storage region 46 has a destination pertaining to the group of destinations D1 to D4. A detector 54 reads the direction of each article which passes in front of it. Using this information, each article is assigned to the appropriate one of the conveyors 28 associated with the stackers 30 to 36.

The sorting installation further comprises means, not shown, for controlling the transfer of articles stored temporarily in the intermediate storage regions M'2, M'3, etc. to the common conveyor 10, in such a manner that there is no interference with the articles coming from the intermediate storage regions associated with the other sorting machines M2 to M5. Moreover, the articles stored in an intermediate storage region are transferred to the common conveyor 10 in groups, not one by one. When the articles are letters, this means that a certain number of theses, stored in the same intermediate storage region, are conveyed simultaneously to the conveyor 10, thus forming a series of shingled letters, i.e. partially overlapping. These are thus series of letters separated from one another so as to avoid interference. The temporary storage regions 46 receive these series of letters and have the function of destacking them. Thus, it will be understood that the flow of letters or more generally articles on the common conveyor 10 can be very substantially increased. The control means manage the transfer of articles from the intermediate storage regions to the common conveyor 10 in such a manner that this transfer does not take place when the intermediate storage region contains a sufficient number of articles and that the series of articles resulting from this transfer runs no risk of interfering with a series of articles coming from another intermediate storage region.

It will be understood that, in relation to the low usage destinations, since each machine is dedicated to a set of these destinations, the conveyors associated with each of these destinations have an acceptable level of usage, since the set of articles having these destinations transfers by the conveyors installed in the same sorting machine M1 to M5.

In the example described above, the installation comprises five sorting machines and each sorting machine is associated with four intermediate storage regions M'2 to M'5. It will be understood more generally that, if the sorting installation comprises n sorting machines, each sorting machine will be associated with n−1 intermediate storage regions, each intermediate storage region being associated with the low usage destinations corresponding to each of the other n−1 sorting machines respectively.

What is claimed is:

1. An installation for sorting articles having different destinations, said destinations being divided into N groups of little-used destinations, wherein the installation comprises: n sorting machines, each machine $M_i$ comprising $p_i$ storage regions corresponding to $p_i$ of the N groups of little-used destinations, in such a manner that $$\sum_{i=1}^{i=n} p_i = N;$$

and common article transfer means connecting the n machines $M_i$ in a closed circuit;

each sorting machine comprising: conveyor means for transferring the articles placed on its input having such destinations as pertain to the $p_i$ groups associated with the machine to the $p_i$ storage regions of the machine; n−1 intermediate storage regions, each intermediate storage region being associated with the group of destinations associated with a respective one of the n−1 other machines; conveyor means for transferring the articles of the destination not pertaining to the $p_i$ groups of destinations corresponding to the machine to the appropriate intermediate storage regions; means for transferring the articles stored in each intermediate storage region to said common transfer means; temporary storage means for storing the articles placed on said common transfer means whose destination pertains to one of the $p_i$ groups associated with said machine; and means for conveying the articles stored in the temporary storage means to said conveyor means corresponding to said $p_i$ storage regions of the machine in accordance with their destinations;

wherein the destinations for the articles also comprise T groups of destinations of full usage, and wherein each sorting machine comprises T main storage regions associated with the T groups of destinations respectively.

2. An installation for sorting articles according to claim 1, wherein each sorting machine comprises main transfer means connecting the input of the machine successively to the conveyor means to the main storage regions and to the transfer means to the storage regions corresponding to the little-used destinations, and wherein the transfer means to the intermediate storage regions and the transfer means leading to the temporary storage regions are connected to the main transfer means between said conveyor means to the main storage regions and the storage regions corresponding to the little-used destinations.

3. An installation for sorting articles according to claim 1, wherein said transfer means of the intermediate storage regions to the common article transfer means effect the transfer of articles in groups, in such a manner that said articles will be taken up by the common transfer means in groups also, and wherein said temporary storage means are adapted to de-stack said groups of articles.

* * * * *